US008063580B2

(12) United States Patent
Saveliev et al.

(10) Patent No.: US 8,063,580 B2
(45) Date of Patent: Nov. 22, 2011

(54) CIRCUIT ARRANGEMENT AND METHOD OF DRIVING A HIGH-PRESSURE GAS DISCHARGE LAMP

(75) Inventors: Anatoli Saveliev, Aachen (DE); Gennadi Tochadse, Aachen (DE)

(73) Assignee: Koniklijke Philips Electronics N.V., Eindohven (NL)

( * ) Notice: Subject to any disclaimer, the term of this patent is extended or adjusted under 35 U.S.C. 154(b) by 613 days.

(21) Appl. No.: 12/278,449

(22) PCT Filed: Jan. 26, 2007

(86) PCT No.: PCT/IB2007/050269

§ 371 (c)(1), (2), (4) Date: Aug. 6, 2008

(87) PCT Pub. No.: WO2007/091186

PCT Pub. Date: Aug. 16, 2007

(65) Prior Publication Data

US 2009/0174330 A1 Jul. 9, 2009

(30) Foreign Application Priority Data

Feb. 6, 2006 (EP) ..... 06101310

(51) Int. Cl.
*H05B 37/02* (2006.01)

(52) U.S. Cl. ..... 315/291; 315/209 CD; 315/244; 315/82

(58) Field of Classification Search ..... 315/77, 315/82, 209 CD, 227 R, 244, 246, 276, 283, 315/291

See application file for complete search history.

(56) References Cited

U.S. PATENT DOCUMENTS 5,892,332 A * 4/1999 Drews et al. ..... 315/209 CD
2005/0001559 A1 1/2005 Batz

FOREIGN PATENT DOCUMENTS

DE 19951114 A1 3/2001

* cited by examiner

*Primary Examiner* — Shawki S Ismail
*Assistant Examiner* — Jany Tran

(57) ABSTRACT

A pair of magnetically coupled inductors forms a current-compensated choke arrangement for reducing electromagnetic disturbances and for weakening the effects of glitch pulses during the ignition of a high-pressure discharge lamp. To further reduce these disturbances and glitch pulses, a resistor having a resistance value that is based on the impedance of the inductors within a given frequency range is arranged in series between a voltage source and the ignition device of the high-pressure discharge lamp. A filter capacitor across the input side of the current-compensated choke also further reduces these disturbances and glitch pulses.

21 Claims, 6 Drawing Sheets

CIRCUIT ARRANGEMENT AND METHOD OF DRIVING A HIGH-PRESSURE GAS DISCHARGE LAMP

Figure 1:
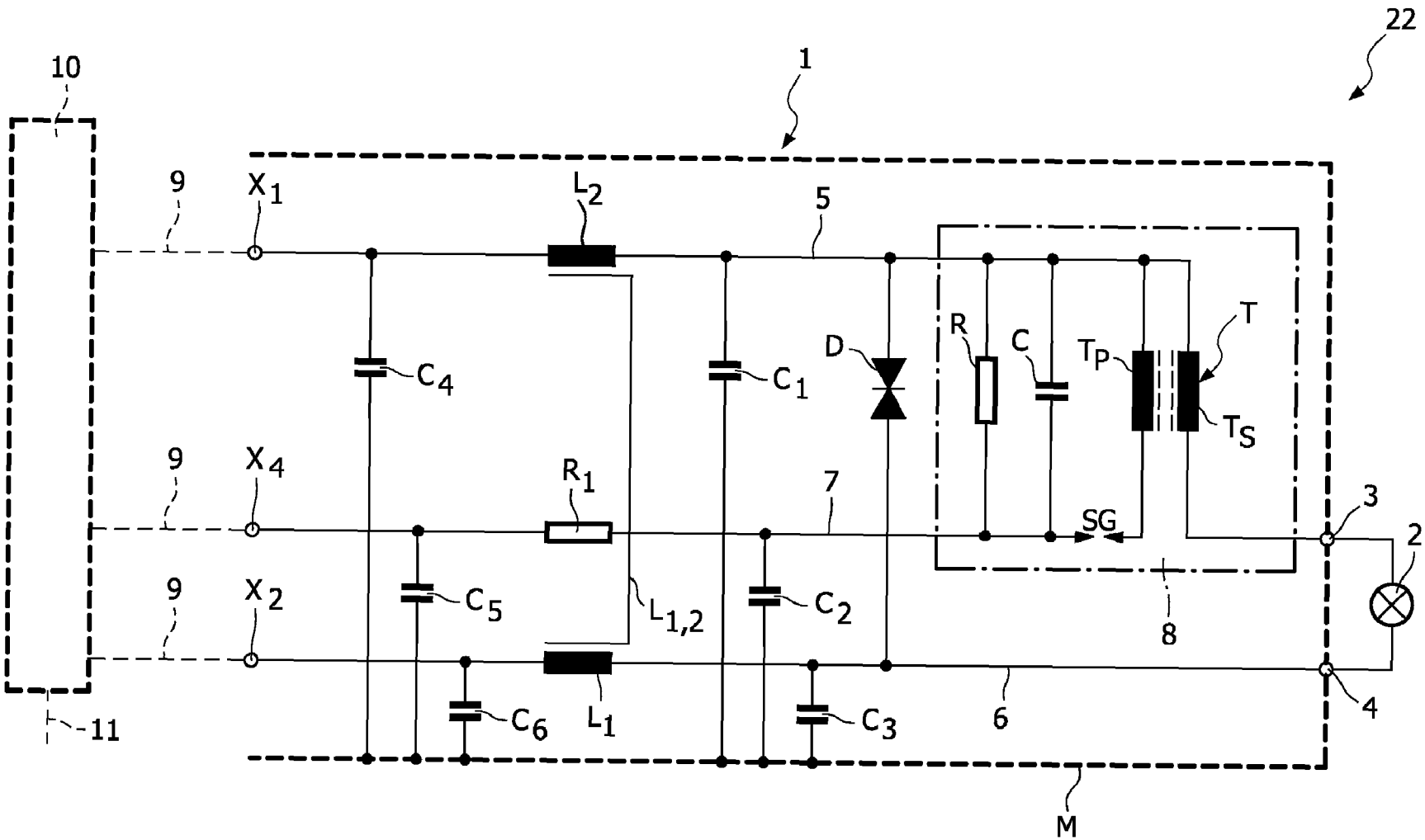

The invention relates to a circuit arrangement and a method of driving a high-pressure gas discharge lamp. Furthermore, the invention relates to a lamp unit comprising a high-pressure gas discharge lamp and having such a circuit arrangement and to a headlight with such a lamp unit.

Such high-pressure gas discharge lamps essentially comprise a discharge vessel into which two electrodes project, as a rule arranged on opposite sides of the discharge vessel, which electrodes are connected to supply lines to the seal sections which are arranged at the discharge vessel, through which lines the lamp can be connected to the circuit arrangement for power supply. The discharge vessel is filled with a gas, normally a rare gas or a rare gas mixture at a relatively high pressure. Typical examples of such high-pressure gas discharge lamps are so-termed HID lamps (High Intensity Discharge lamps), particularly MPXL (Micro Power Xenon Light) lamps, which are used mainly for automobile headlights. The arc ignited in such lamps causes a high temperature, which leads to the light emission of the rare gases in the discharge vessel as well as of the added materials in principle, for example mercury and mixtures of metal halides. The arc in the lamp is normally ignited by means of a high voltage pulse. The higher the pressure of the gas in the discharging envelope, the higher the luminous efficacy of such lamps. But disadvantageously, a higher pressure of the gas also requires a higher breakdown voltage, i.e. at a higher pressure a higher voltage should be applied to the electrodes of the high-pressure gas discharge lamps in order to ignite the lamp. Normally, the breakdown voltage is several thousand volts; with the high-pressure gas discharge lamps of the latest generation the breakdown voltage is, for example, of the order of magnitude of 20 kV. As soon as the lamp is ignited, it should be led into stationary operation in a so-termed take-over process. During this take-over, the lamp electrodes are heated up to the temperature typical of stationary operation. A significantly lower voltage is needed for maintaining the arc during take-over and in stationary operation. Here, voltages typically in the range of some hundreds of volts are applied to the electrodes for take-over and below 100 V for stationary operation.

In order to drive the high-pressure gas discharge lamp suitably, both during ignition and in subsequent operation, appropriate circuit arrangements are needed. These circuit arrangements have terminals for different voltage potentials as well as for supplying a certain voltage for igniting the lamp. The necessary voltage potentials are normally provided by an operating apparatus of the lamp, denoted electronic ballast, which in its turn is connected, for example, to an electrical system of the automobile. Within the circuit arrangement, these terminals for the different voltage potentials are connected via electrical connections to the terminals for the high-pressure gas discharge lamp. In addition, such a circuit arrangement has an ignition device which is connected at the input side to the terminal for the voltage supply for igniting the lamp and at the output side to one of the terminals for the high-pressure gas discharge lamp. The application of a suitable voltage to the specially provided terminal of the ignition device generates a suitable high voltage within the ignition device, which voltage is temporarily present at the relevant terminal of the high-pressure gas discharge lamp, thus providing an ignition of the lamp. As the circuit arrangement primarily serves the ignition of the lamp, it is normally also called "ignition module".

Once ignited, the high-pressure gas discharge lamps are operated, for example, with a square-wave signal having a frequency of some 100 Hz. Electromagnetic radiation in the range of some 10 MHz up to some 1000 MHz may develop during burning of the lamp. These disturbances may lead to electromagnetic interferences (EMI) with the other electronic devices in the vehicle.

Generally, the emission of electromagnetic disturbances in automobiles is permissible only at a very low level, such that the control of certain components inside the vehicle is not disturbed. These may also be e.g. safety-relevant components. In addition, the disturbances in the FM frequency range between 87 and 108 MHz may reduce the quality as well as the possibility of radio reception in the above-mentioned frequency range, whereby the driving comfort of the end-users (automobile drivers and passengers) is directly affected. In addition, disturbances should also be avoided as far as possible within the entire TV range from 45 to 820 MHz and in the entire range of mobile services in the range of 30 MHz to 1000 MHz. A further problem with the design described above is that the extremely fast high-voltage potential changes during ignition of the lamp produces an interfering pulse with a duration of only a few nanoseconds and an amplitude of some 100 V. Here, voltages of up to above 1000 V are reached at the terminals between the circuit arrangement and the ballast. Such an interfering pulse is normally also called a "glitch". Such a glitch pulse may then spread through the connecting lines towards the ballast and damage or even completely destroy the ballast or the ballast components.

A circuit arrangement filtering out particularly the disturbances in the FM band is described in US2005/0001559 A1, wherein inductors are arranged at the input side directly behind the first and second terminals for the first and the second voltage potential as well as the third terminal for supplying an ignition voltage in the electrical connections, which inductors are coupled to one another such that they form a current-compensated choke or "common-mode choke". In a modification, it is suggested that an appropriate current-compensated choke with three windings be used for applying the third voltage potential and the ignition device, which interconnects all three terminals or electrical connections, both in the electrical connecting lines of the first and the second terminal for the first and second voltage potential and in the electrical connection to the third terminal. Moreover, coupling of only the first terminal for the first voltage potential and the second terminal for the second voltage potential to one another via a usual current-compensated choke having two windings is suggested in a simplified embodiment.

While the former modification with a current-compensated choke having three windings is quite well suited for filtering out the disturbing electromagnetic interferences, particularly in the desired range from 87 to 108 MHz, the latter modification involves the problem that significant disturbances may occur via the third terminal for supplying the ignition voltage. However, the former modification has the disadvantage that an expensively manufactured and relatively bulky three-way current-compensated choke should be used for this purpose, which increases the price of the entire circuit design.

It is an object of the present invention to provide an alternative circuit arrangement and an appropriate method of driving high-pressure gas discharge lamps, which on the one hand avoids just as reliably or significantly reduces the electromagnetic disturbances of the lamp while using a three-way current-compensated choke, which in addition reduces the risk of a destruction of the ballast by a glitch pulse, but which on the other hand is of a less expensive construction.

This object is achieved by a circuit arrangement as defined in claim 1 and by a method as defined in claim 13.

A circuit arrangement according to the invention comprises, as mentioned above, a first terminal for a first voltage potential, a second terminal for a second voltage potential, and a third terminal for applying a third voltage potential, wherein the first and the second terminal serve to supply the high-pressure gas discharge lamp in the continuous mode of operation and the first and third terminal serve to supply the ignition device for igniting the high-pressure gas discharge lamp. In addition, the circuit arrangement comprises a first electrical connection which at its first end provides a first connection terminal for a high-pressure gas discharge lamp and which is coupled at its second end to the first terminal for the first voltage potential, and a second electrical connection which at its first end provides a second connection terminal for a high-pressure gas discharge lamp and which is coupled at its second end to the second terminal for the second voltage potential. The circuit arrangement further comprises an ignition device whose input is connected at least to the third terminal and whose output is coupled to one of the connection terminals for the high-pressure gas discharge lamp. For reducing the electromagnetic disturbances and for weakening the effects of the glitch pulse during ignition, the first electrical connection and the second electrical terminal comprise a first and a second inductive element, respectively, which are magnetically coupled to each other such that together they form the current-compensated choke, while the third electrical connection comprises an electrical resistor of more than or equal to 10Ω between the ignition device and the third terminal.

Various tests have shown that the same effect can be obtained as with a current-compensated choke having three windings which couples the first, the second, and the third electrical connection if a current-compensated choke is connected only in the first and the second electrical connection, whereas an ohmic resistor of a certain size is used instead in the third electrical connection. The third winding in the third electrical connection may thus surprisingly be replaced by a simple, sufficiently high resistor without this being disadvantageous in reducing the disturbance. This enables a more favorable manufacture of the circuit arrangement. Thus, the choke can be manufactured more economically on the one hand. On the other hand, the assembly is more economically feasible, as each wire of such a choke should normally be connected manually into the circuit arrangement, whereas a resistor can be mounted in a fully automated manner. The solution according to the invention thus requires two wires fewer to be connected manually than with does the solution with a three-way current-compensated choke. Such a cost saving is advantageous particularly if the circuit arrangement with the high-pressure gas discharge lamp is connected to a lamp unit, i.e. is integrated preferably in a socket housing of the high-pressure gas discharge lamp. Such lamp units are also called "lamps with an integrated ignition module". When the lamp is replaced, the complete circuit arrangement is replaced along with it in such a design. The complete circuit arrangement is then a non-repairable item, so that it is particularly important to be able to offer a economical circuit arrangement. A further advantage of the solution according to the invention is that a current-compensated choke having three windings is more bulky owing to the necessary minimum wire size than a current-compensated choke with only two windings. Therefore, the structure according to the invention has a smaller total space requirement, which not only reduces its cost, but also allows the use of an integrated ignition module for some headlight or automobile models for the very first time.

Given an appropriate method according to the invention of controlling a high-pressure gas discharge lamp, the high-pressure gas discharge lamp is supplied with a certain operating voltage by a power supply device in stationary operation via a first electrical connection with a first terminal for a first voltage potential and a first connection terminal for the high-pressure gas discharge lamp as well as via a second electrical connection with a second terminal for a second voltage potential and a second connection terminal for the high-pressure gas discharge lamp. For igniting the high-pressure gas discharge lamp, a high-voltage pulse produced in an ignition device is applied to one of the terminals of the high-pressure gas discharge lamp in that a third voltage potential is applied to a third terminal connected to this ignition device at the input side thereof. According to the invention, this method reduces the interfering pulses, which particularly load the power supply device and which appear at the first terminal for the first voltage potential and at the second terminal for the second voltage potential, by means of a first inductor arranged in the first electrical connection and a second inductor arranged in the second electrical connection, which second inductor together with the first inductor forms a current-compensated choke. In addition, an electrical resistor of more than 10Ω arranged between the ignition device and the third terminal reduces interfering pulses that appear at the third terminal, particularly those pulses that affect the power supply device.

The dependent claims comprise particularly advantageous embodiments and further embodiments of the invention. Particularly, the method of operating a high-pressure gas discharge lamp may also be further developed by analogy to of more the dependent claims of the circuit arrangement.

As described, it has proved that a resistor larger than 10Ω is sufficient for significantly reducing the disturbances appearing at the third terminal. Depending on the actual construction of the high-pressure gas discharge lamp and the circuit arrangement as well as the control pulses used, however, larger resistors, for example of more than or equal to 1 kΩ, preferably of more than or equal to 5 kΩ, particularly preferably of more than or equal to 20 kΩ may be used.

In addition, investigations have shown that there is a dependence between impedances of the inductors arranged in the first and the second electrical connection and the resistor to be selected optimally. The resistor should have a suitable ratio to the maximum impedance of the choke in the respective frequency range. Thus, the resistor should at least be greater than or equal to one tenth of the respective, preferably greater than or equal to the maximum impedance of the inductors arranged in the first and the second electrical connection for a specified frequency range.

Here, the frequency range to be considered depends on which frequency range is to be filtered first of all from the interference spectrum. If it is the object to filter out the disturbances from the FM range, then the frequency range to be considered should preferably be between 50 MHz and 150 MHz. Incidentally, as the glitch pulse also has its highest power in the 100 MHz range and the power of the higher harmonics drops drastically, the range from 50 MHz to 150 MHz is also very suitable for reducing the glitch pulse. However, this does not exclude that a broader frequency range of 20 to 1000 MHz may be considered even if, for example, all the disturbances in the TV frequency range or in the frequency range of the mobile communications are to be reliably filtered out.

For the actual construction of the circuit arrangement there a wide variety of possibilities. In a preferred embodiment, a secondary winding of a transformer of the ignition device is located in the first electrical connection, and one side of a capacitor of the ignition device and parallel thereto one side of the primary winding of the transformer are connected to the first electrical connection between the first terminal for the first voltage potential and the secondary winding of said transformer. The third terminal of the circuit arrangement, which supplies the voltage for igniting the lamp, is then connected by the other side of the capacitor via the resistor and via a circuit element of the ignition device parallel thereto, for example, to the other side of the primary winding of the transformer via a spark gap. This structure may be manufactured in a particularly compact and economical way.

Highly preferably, the first electrical connection between the first inductor and the first connection terminal for the high-pressure gas discharge lamp—preferably between the first inductor and the capacitor—on the one hand and the second electrical connection between the second inductor and the second connection terminal for the high-pressure gas discharge lamp on the other hand are connected to each other via a voltage-limiting element. This voltage-limiting element, for example a transil diode or a Zener diode, becomes conducting starting from a certain voltage and contributes to a limitation of the voltage increase that takes place rapidly after ignition of the lamp. The build-up of the high voltage between the first terminal and the second terminal after the ignition of the lamp is reduced thereby, and thus the danger of a ballast failure is reduced. Alternatively, a suitable capacitive element, for example a capacitor with a capacitance of a few 100 pF to some μF, may be used for this purpose instead of a transil or a Zener diode.

In a particularly preferred modification, furthermore, the first electrical connection and the second electrical connection are coupled capacitively to one another at the input side upstream of the current-compensated choke. This capacitive coupling may be provided between the first terminal for the first voltage potential and the current-compensated choke or alternatively between the second terminal for the second voltage potential and the current-compensated choke. In addition, it may be realized equally well on the supply lines to the first terminal and the second terminal, i.e. on the connection cables from the ballast to the circuit arrangement. It has been shown that such a capacitive coupling between the first and the second terminal is itself sufficient for significantly reducing the back-propagation of the ignition interference pulse, i.e. the glitch pulse. Therefore, it is not mandatory to couple all individual terminals or supply lines capacitively against a surrounding ground. A simple capacitive coupling between the two supply lines or terminals before the first and the second inductor, i.e. at the input side upstream of the current-compensated choke, is significantly more economical than such a capacitive coupling of all individual conductors by means of capacitors connected against a ground potential.

Such a capacitive coupling may be provided particularly economically, and therefore preferably, via a parasitic capacitance, for example by an appropriate arrangement of the supply cables or of the electrical connections within the circuit arrangement.

A preferred embodiment thus ensures that a parasitic capacitance between the first electrical connection and the second electrical connection is increased by a widening of a conductor track of the relevant electrical connection and/or by an electrical connection of at least one additional conducting surface to the relevant electrical connection terminal. Preferably, this method is also used for artificially increasing or suitably adjusting the parasitic capacitance between the first electrical connection and the surrounding ground and/or between the second electrical connection and the surrounding ground and/or between the third electrical connection and the surrounding ground, as applicable.

Incidentally, a utilization and a suitable design of the parasitic capacitance may also be useful in other circuit arrangements that function without a current-compensated choke or without the resistor in the third electrical connection. Such a practice does indeed increase the design expenditure a little as the suitable parasitic capacitances may normally be determined exactly only by experiments, but against this the manufacturing cost can be reduced thereby, which is highly important particularly with a mass-produced article and a non-repairable item, such as a lamp unit with an integrated ignition module.

Therefore, as described above, the invention has special advantages when used in appropriate lamp units with which the circuit arrangement is integrated, for example, into a socket housing of the high-pressure gas discharge lamp and, together therewith, is inserted and exchanged as a complete sub-assembly into the headlight of an automobile. This, however, does not exclude that the invention may also be used to advantage with other circuit arrangements and for other lamps.

These and other aspects of the invention are apparent from and will be elucidated with reference to the embodiments described hereinafter.

Figure 2:
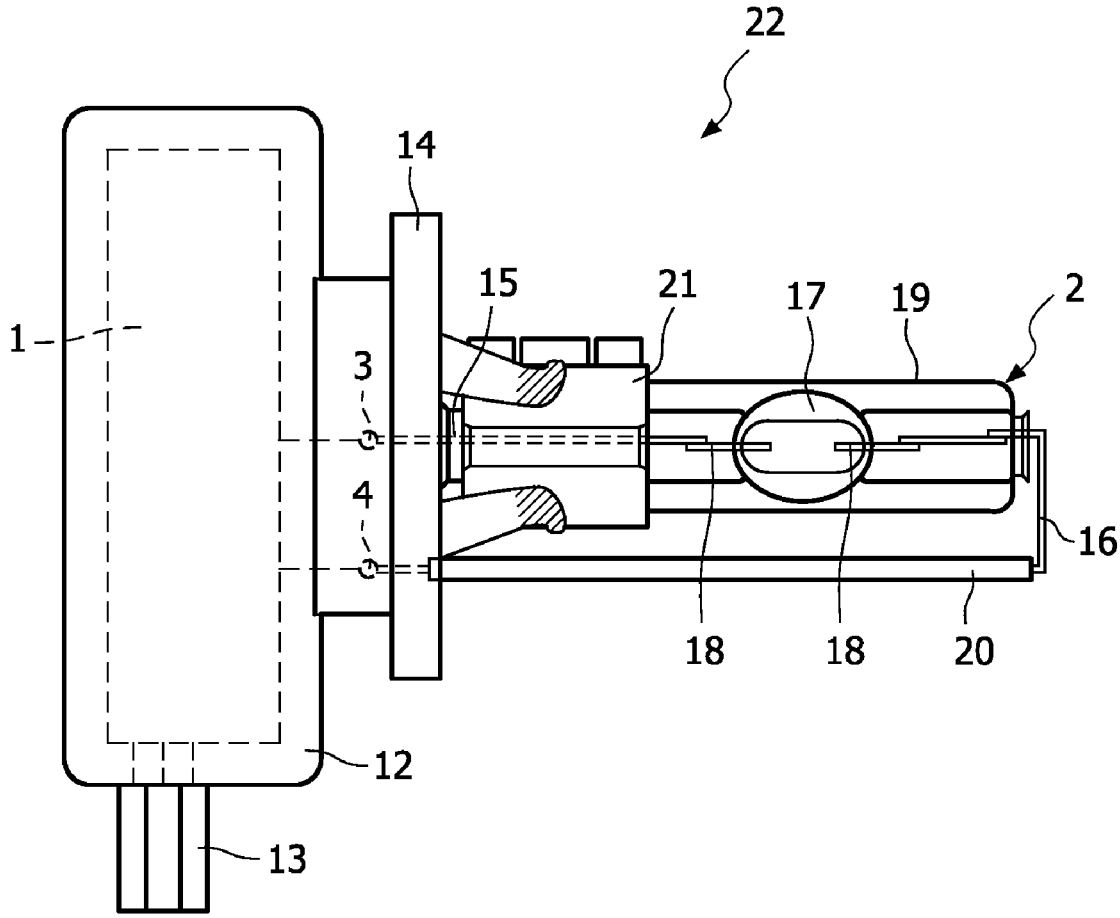
Figure 3:
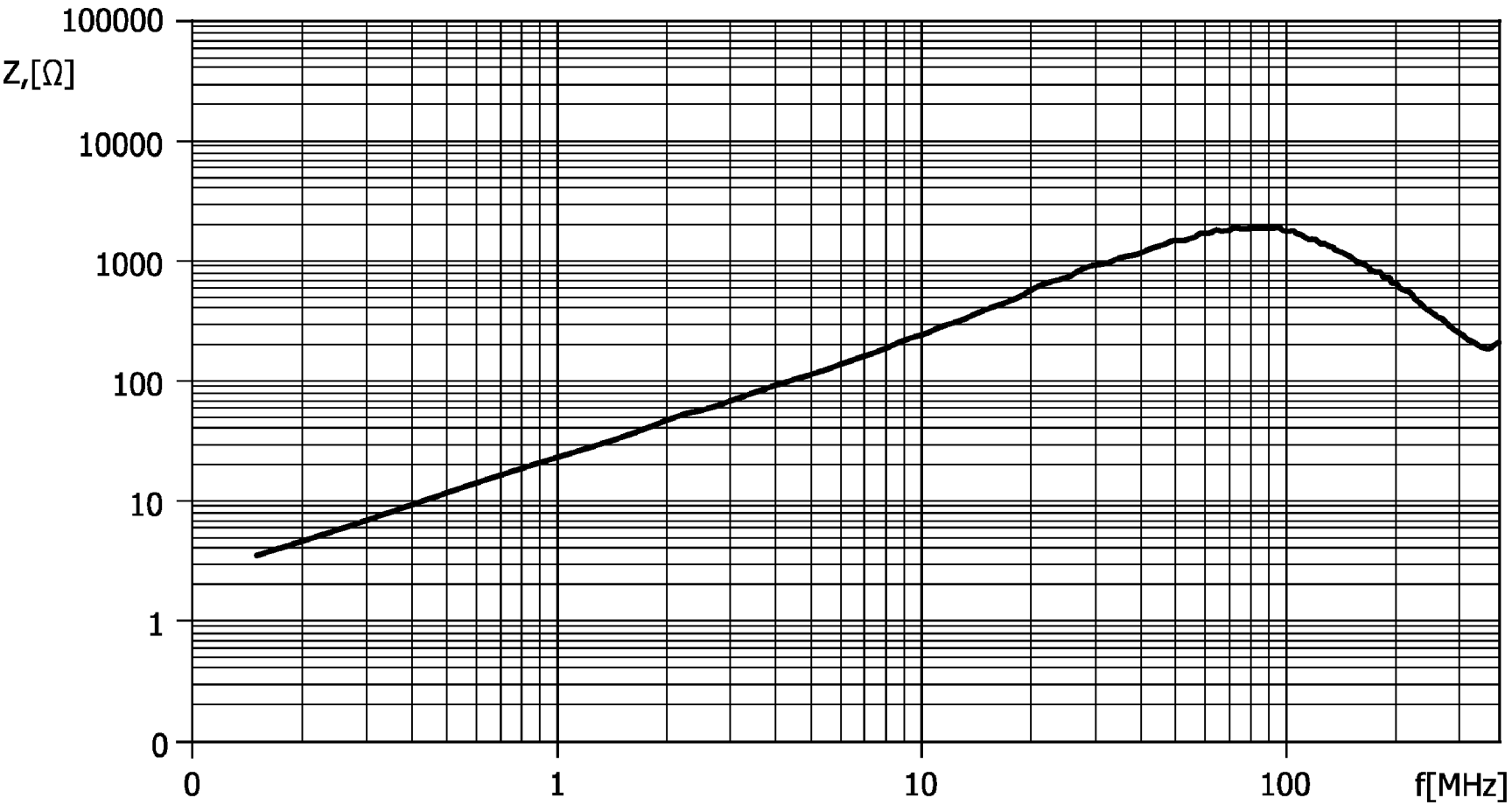
Figure 4:
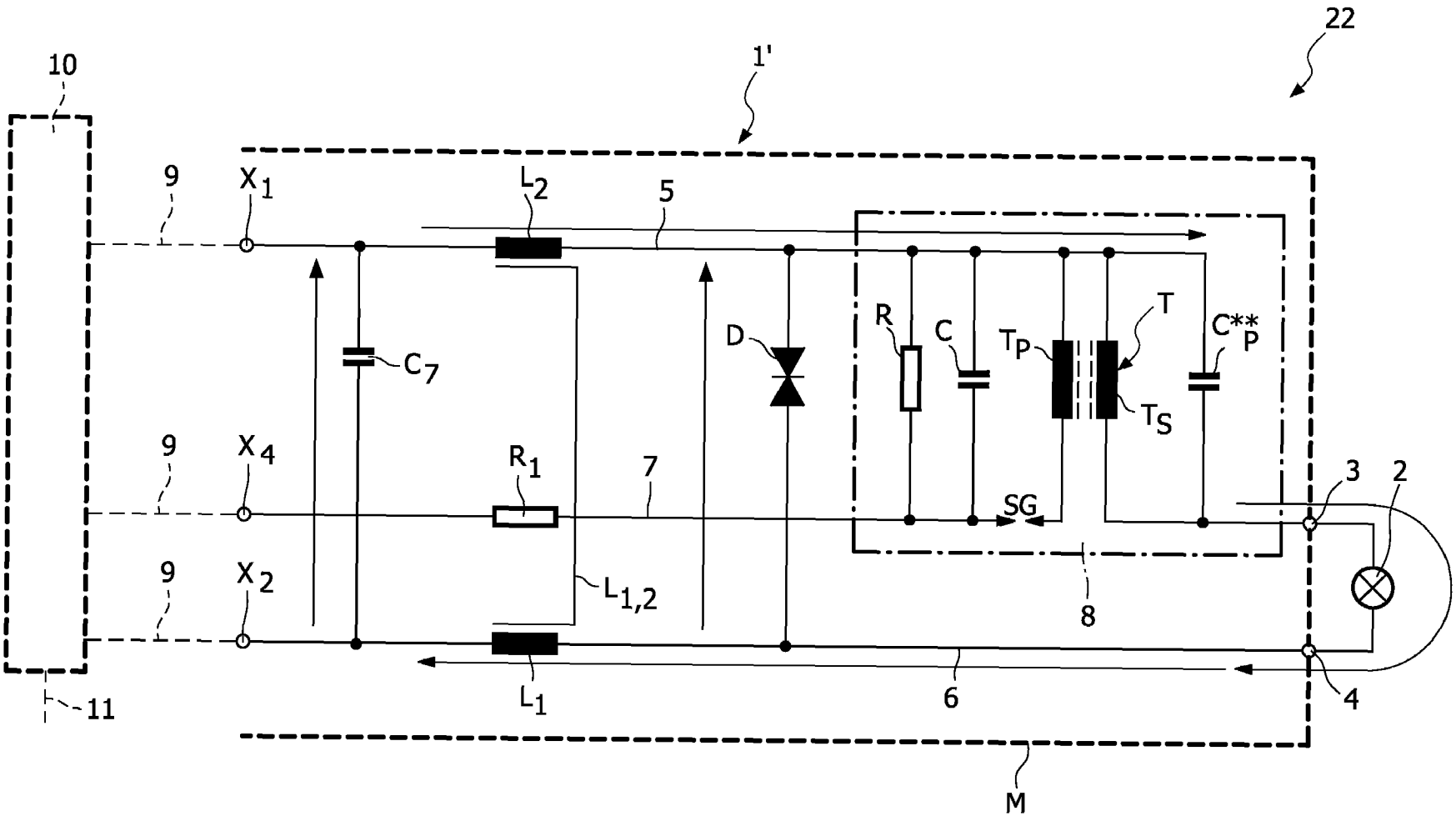
Figure 5:
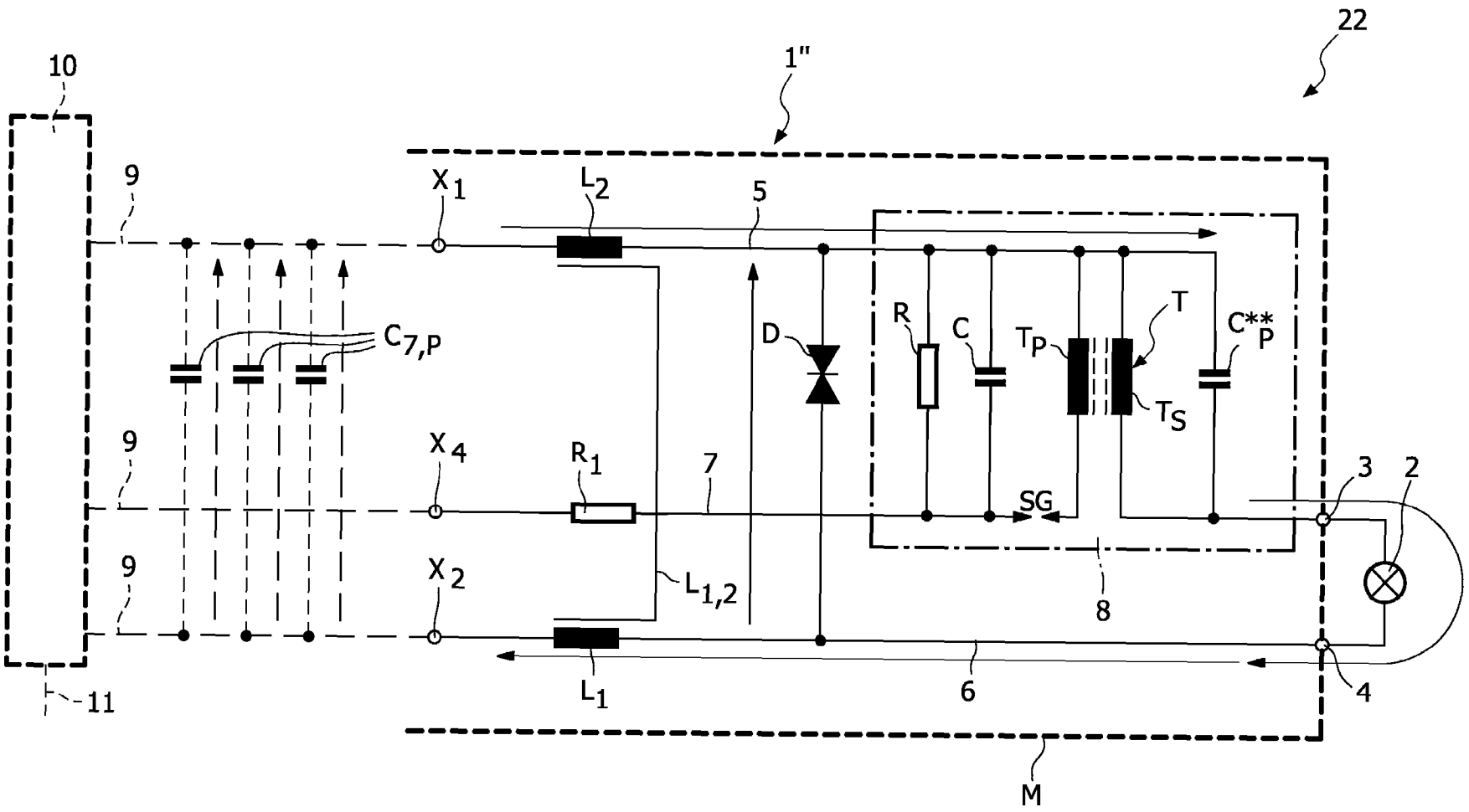
Figure 6:
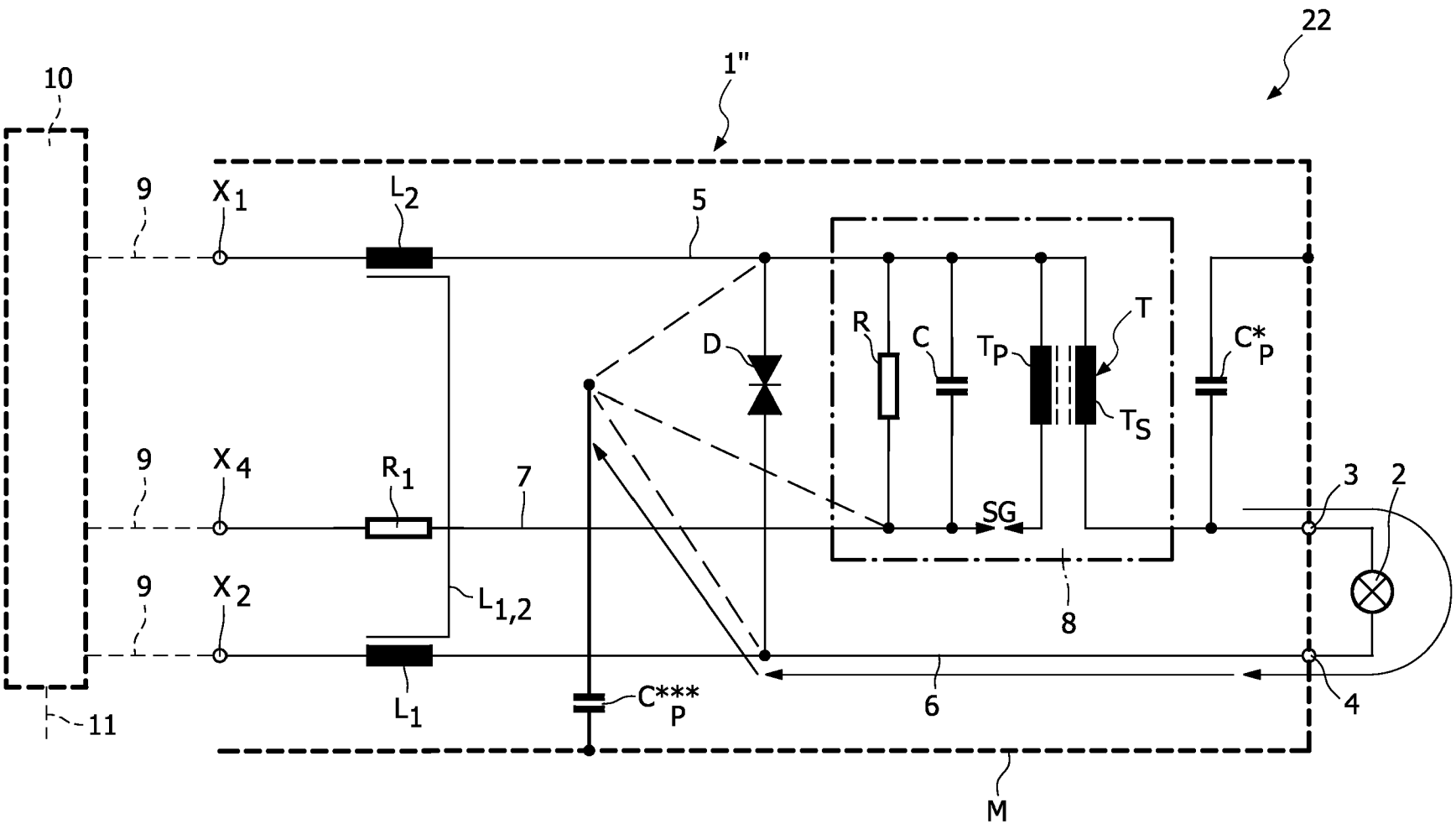

In the drawings:

FIG. 1 shows a circuit diagram of a first embodiment of a circuit arrangement according to the invention, FIG. 2 is a side elevation of a lamp unit comprising a high-pressure gas discharge lamp and a socket housing with which a circuit arrangement according to the invention is integrated, FIG. 3 shows the measured frequency-dependent impedance of a choke, FIG. 4 shows a circuit diagram of a second embodiment of a circuit arrangement according to the invention, FIG. 5 shows a circuit diagram of a third embodiment of a circuit arrangement according to the invention with a schematic representation of the effect of a parasitic capacitance between the first and the second supply line, FIG. 6 shows a circuit diagram of the third embodiment with a schematic representation of the effects of a parasitic capacitance between the individual connecting lines and the grounded shield of the ignition module.

FIG. 1 shows a first embodiment of a structure of a circuit arrangement 1 according to the invention for a usual HID lamp 2 as may be used, for example, in automobile headlights. At the input side this circuit arrangement 1 has three terminals $x_1$, $x_2$, $x_4$ by which the circuit arrangement 1 is connected to a ballast 10. This ballast 10 ensures that, during ignition of the lamp 2 and during subsequent stationary operation, the necessary voltage potentials are applied to the relevant terminals $x_1$, $x_2$, $x_4$ of the circuit arrangement 1 and that the circuit arrangement 1 is supplied with the necessary current. The ballast 10 is normally connected to an electrical system of the automobile via a plug-in connector 11 (the ballast 10 with the connector 11 is only schematically represented in FIG. 1). The circuit arrangement 1 has two terminals 3, 4, at the output side, to which the lamp 2 is connected.

The mechanical structure of a lamp unit 22, comprising the high-pressure gas discharge lamp 2 with a circuit arrangement 1 integrated into a lamp holder housing, is represented in FIG. 2. The high-pressure gas discharge lamp 2 may be seen here, which lamp essentially comprises an inner envelope 17 forming the discharge vessel. Two electrodes 18 extend into the discharge vessel from opposite sides. Ignition of the lamp 2 is caused by a spark generated between the electrodes 18, whereupon a discharge arc is developed.

A rare gas or a mixture of rare gases and a mixture of metal halides and mercury are normally present in the discharge vessel under a high pressure.

Furthermore, there are also mercury-free lamps in which the mercury is replaced by other materials. The discharge vessel 17 is surrounded by an outer envelope 19, which serves inter alia to screen the UV radiation generated in addition to the desired luminous radiation. The hollow space between the outer envelope 19 and the inner envelope 17 is preferably evacuated or under a low pressure, or if necessary also has a normal ambient pressure filled with air or some other gas or gas mixture. At its outer envelope 19, the high-pressure gas discharge lamp 2 is held by means of a ring-shaped holder 21 at a base 14, which is partly integrated into a socket housing 12. The circuit arrangement 1 is located in this socket housing 12.

The ground M surrounding the circuit arrangement 1 and represented in FIG. 1 may be realized, for example, by a metal socket housing 12 or a socket housing with a conducting surface or screen. A plug 13 in the socket housing 12 provides the connection of the circuit arrangement 1 to the ballast 10 (see FIG. 1) via a cable 9 (not shown in FIG. 2). Also located inside the socket housing R1 are the terminals 3, 4 for the lamp 2 and the upline 15 and the return line 16, which are coupled to the electrodes 18 of the high-pressure gas discharge lamp. The electrodes 18 are coupled to the upline 15 and the return line 16 via foil sections in the seals of the lamp envelope 17 in a usual manner.

The upline 15, which leads to the electrode 18 of the lamp 2 and is arranged on the side of the lamp 2 facing the base 14, is directly led into the base 14 and is connected there to the first terminal 3 of the circuit arrangement 1. The electrode 18 located on the side remote from the base 14 is connected to a return line 16, which is passed through an electrically insulated tube 20, preferably of ceramic material, back to the base 14 and is connected there to the second terminal 4 of the circuit arrangement 1.

The electronic structure of the circuit arrangement 1 according to the invention can be found in FIG. 1 again.

The core of this circuit arrangement 1 is the actual ignition device 8, which essentially comprises a transformer T with a primary winding $T_P$ and a secondary winding $T_S$ as well as a spark gap SG, a capacitor C, and a resistor R.

An electrical connection 5 leads to the first terminal 3 for the high-pressure gas discharge lamp 2 from the first terminal $x_1$, to which the first voltage potential is applied by the ballast 10. The secondary winding $T_S$ of the transformer T is arranged on the side of the lamp in this electrical connection 5. Likewise, from the second terminal $x_2$, to which the second voltage potential is applied by the ballast 10, a connecting line 6 leads to the second terminal 4 for the high-pressure gas discharge lamp 2. Thus, what is referred to as a "lamp circuit" is built up between the terminals $x_1$ and $x_2$ via the electrical connections 5, 6 as well as the secondary winding $T_S$ of the transformer and the lamp 2, by which "lamp circuit" the lamp 2 is operated by the ballast 10 during stationary operation.

However, in order to be able to start, i.e. ignite the lamp 2 with a high voltage, the ignition mechanism 8 has the further components as mentioned above, namely the transformer T, whose secondary winding $T_S$ is integrated into the lamp circuit, the capacitor C, the resistor R, and the spark gap SG. These components are coupled to the first terminal x1 or the first electrical connection 5 of the circuit arrangement 1 and a third terminal $x_4$, via which the voltage for igniting the lamp 2 can be supplied by the ballast 10 for igniting the lamp 2, or to a third electrical connection 7 connected to it as follows:

On the one hand, the first electrical connection 5 is connected to a side of the primary winding $T_R$ of the transformer T between the first terminal $x_1$ for the first voltage potential and the secondary winding $T_S$ of the transformer T and, parallel thereto, to a side of the capacitor C and to a side of the resistor R. The other sides of the resistor R and the capacitor C are connected to the third electrical connection 7 and thus to the third terminal $x_4$. In addition, this third electrical connection 7 is connected to the other side of the primary coil $T_P$ of the transformer T via the spark gap SG. Consequently, the capacitor C is connected in parallel in a certain manner also to the primary stage $T_P$ of the transformer T and not only to the resistor R, except for the disconnection by the spark gap SG.

The first electrical connection 5 and the second electrical connection 6 comprise respective inductive elements $L_1$, $L_2$ at their input sides. These inductive elements $L_1$ and $L_2$ are coils which are magnetically coupled to one another, thus forming a current-compensated choke $L_{1,2}$. According to the invention, a resistor $R_1$ is located in the third electrical connection 7 at the input side behind the third terminal $x_4$—instead of such a coil—for supplying the voltage for igniting the lamp 2.

In the embodiment of FIG. 1, the electrical connections 5, 6, 7 are coupled to the surrounding ground M both at the respective input sides before the current-compensated chokes L1, 2 or the resistor $R_1$ and behind the current-compensated chokes $L_{1,2}$ or the resistor $R_1$ via capacitors $C_1$, $C_2$, $C_3$, $C_4$, $C_5$, $C_6$. In addition, the electrical connections 5, 6, which lead from the first and the second terminal x1, $x_2$ for the first and the second voltage potential to the lamp terminals 3, 4, respectively, are interconnected via a voltage-limiting element D, here a transil diode D. Therefore, this voltage-limiting element D is connected in parallel to the current-compensated choke $L_{1,2}$.

The following components are used in the embodiment of FIG. 1:

A high-voltage-stable transformer T with a rod core of ferrite; a capacitor C with a capacitance of about 80 nF, a resistor R of approximately 6.8 MOhm; and a transil diode D with a clip voltage of approximately 520V.

The capacitors C1, $C_2$, $C_3$, $C_4$, $C_5$, $C_6$ may be of the order of magnitude of a few 100 pF.

The operation of the components T, C, R of the ignition device 8, of the further components such as the capacitors $C_1$, $C_2$, $C_3$, $C_4$, $C_5$, $C_6$ of the transildiode D, of the current-compensated choke $L_{1,2}$, and of the resistor $R_1$ will now be described below.

In order to ignite the lamp 2, first the capacitor C is charged via the terminals $x_1$ and $x_4$. The spark gap SG is dimensioned such that it becomes conductive at around 800 V. This has the consequence that the capacitor C charged to approximately 800 V is discharged into the primary winding $T_P$ of the transformer T through the spark gap SG. A high voltage of the order of 20 kV is developed thereby in the secondary winding $T_S$ of the transformer T, which voltage is then present in the high-voltage section between the transformer T and the lamp 2, i.e. in the upline 15, before the ignition of the lamp 2. The other side of the lamp 2 is connected to the terminal $x_2$ by the inductive element $L_1$ (that is, the current-compensated choke $L_{1,2}$) and is at a lower potential before ignition.

Normally, the lamp 2 is started with only a single ignition pulse. If the lamp 2 does not start successfully, the capacitor C in the ignition device 8 is charged again so as to start the lamp 2 with further ignition pulses. As soon as the desired breakdown has occurred in the discharge vessel, the lamp 2 itself may be regarded as a relatively low-ohmic resistor. Via the terminals $x_1$ and $x_2$, the lamp 2 is then supplied by the ballast 10 with the usual operating voltage, depending on the structure of the ballast 10, for example, a square wave voltage, between some 10 up to few 100 V. Here, for example, half of the nominal voltage may be applied to the respective terminals $x_1$ and $x_2$. Any voltage of up to some hundreds of volts may be present at the third terminal $x_4$ for the purpose of applying the ignition voltage. This voltage must only not be so high that the spark gap SG breaks down. This third terminal $x_4$ is at a floating potential in many ballasts. The normally high-ohmic resistor R in the ignition module 1 is inserted for safety reasons, in order to reduce the possible residual charge from the capacitor C, so that a potential is maintained at terminal $x_4$, which corresponds more or less to the potential present at the first terminal $x_1$, thus preventing the generation of further, undesired ignition impulses.

As described above, electromagnetic pulses arise in the ignition module during ignition and operation of the lamp 2, which may lead to interference with other signals in the automobile. Most of the electromagnetic interference (EMI) problems arise with the presently used so-termed D1-lamps in the frequency range of 70 to 108 MHz, i.e. the typical FM range, but in some cases also in the lower frequency ranges, between 30 and 54 MHz.

A further problem is that the rapid potential change taking place during ignition of the high-pressure gas discharge lamp 2, from approximately 20 kV to a value of below some 100 V, in the high-voltage line between the secondary winding $T_S$ of the transformer T and the lamp 2 (i.e. also in the upline 15) may cause very rapid and highly interfering pulses to appear with a build-up time of the order of 1 ns, a duration of only a few ns, and a height of 1000 V and more, which load the ballast 10 via the terminals $x_1$, $x_2$, and $x_4$ and may lead to a destruction of or damage to the ballast. As a countermeasure against this glitch pulse, the first electrical connection 5 and the second electrical connection 6, i.e. the first and the second terminal $x_1$ $x_2$, are coupled via the transil diode D, which acts as a voltage-limiting element. A significant portion of the voltage of the strongly interfering pulse is already reduced across this element.

In addition, the first electrical connection 5 and the second electrical connection 6, i.e. the terminals $x_1$, $x_2$, are coupled to one another via the current-compensated chokes $L_{1,2}$ in order to improve the electromagnetic compatibility of the entire circuit arrangement and to reduce the disturbing effects of the glitch pulse still further. The operation for counteracting the electromagnetic interference and the structure of such current-compensated chokes $L_{1,2}$ may be abstracted from the document US 2005/0001559 A1 cited above and are indeed known in principle to those skilled in the art. Instead of such an inductance, there is a simple ohmic resistor R1 in the third electrical connection 7, which leads from the third terminal $x_4$ to the ignition device Z. Here, the order of magnitude of this resistor $R_1$ is preferably adapted to the impedance to be achieved by the current-compensated choke $L_{1,2}$ within the frequency range to be shielded.

Calculations have shown that a minimum inductance of 1 μH of the two coils $L_1$, $L_2$ should be provided for the above-mentioned frequency range of 80 to 108 MHz. However, the value should preferably be larger than or equal to 10 μH, particularly preferably higher than or equal to 15 μH. Ideally, the value is of the order of 20 to approximately 25 μH. Of course, coils having a higher inductance may also be selected, but it is to be considered here that this will increase the price of the structure and above all demands a larger volume.

Firstly, the impedances of these two coils $L_1$, $L_2$ are to be determined in order to adapt the resistor R1 in the third electrical connection 7 to the impedances of the coils $L_1$, $L_2$ of the current-compensated choke $L_{1,2}$ in the electrical connections 5 and 6.

However, the impedance of the coils $L_1$, $L_2$ is frequency-dependent. A measure for this purpose is shown in FIG. 3 for coils of 25 μH. Here, the impedance Z in Q is plotted against the frequency f of the interfering pulses in MHz, logarithmic scales being used. As is apparent from this graph, the impedance has a clear maximum at approximately 100 MHz. This is because impedance is determined by the coil inductance for lower frequencies. For higher frequencies, however, the parasitic capacitance of the coils vis-à-vis the environment becomes apparent, thus providing a drop in the impedance curve.

Such a choke has its maximum effect as a filter against disturbances if the choke is selected such that its maximum impedance lies in the region of the frequency range to be filtered out. The graph thus also shows that the choke $L_{1,2}$ selected here with an inductance in the range of 25 μH for use in an ignition module of an automobile lamp is ideal as an example of an embodiment. As described above, the most disturbing frequency range in an automobile is between 80 and 108 MHz. This is exactly the range in which the maximum of the impedance of the coils lies in this case. Furthermore, this choke also has a good effect in the entire range from 10 MHz to some hundreds of MHz.

In addition, the inductance is here selected such that the choke with the coils $L_1$, $L_2$ does not get saturated too soon through absorption of the power of the glitch pulse. At a value of 25 μH and an assumed pulse height of 2.5 kV, this is the case only after approximately 10 ns with an assumed saturation at approximately 1 A.

The maximum impedance of this choke is (as can also be seen from FIG. 3) approximately 2 kΩ. Therefore the resistor $R_1$, which is connected instead of a further winding in the electrical connection 7 between the third terminal $x_4$ and the ignition device 8, was selected such that it is above this maximum impedance. A resistor $R_1$ of precisely 5.8 kΩ was selected for the embodiment shown here.

With the help of this resistor $R_1$, a high-frequency filter is created between the ignition device 8 and the ballast 10, whose effectiveness is not less than the effectiveness of a similar filter with a common-mode choke having 3 windings.

The capacitors C2, $C_3$, $C_4$, $C_5$, $C_6$ used in the circuit design of FIG. 1, which couple the electrical connections 5, 6, 7 in front and behind the current-compensated choke $L_{1,2}$ or the resistor $R_1$ to the grounded shield of the ignition module M, help primarily in weakening the glitch pulse further and in improving the EMI behavior of the lamp. The capacitors $C_1$, $C_2$, $C_3$ also avoid the build-up of a high voltage on the return line 4, 16 after the ignition process in the lamp.

Here, it is to be considered that such a glitch pulse is affected by two mechanisms. One mechanism may be explained by the parasitic capacitance $C_p$* which inevitably arises between the high-voltage transmission line between the secondary coil $T_S$ of the transformer T and the high-pressure gas discharge lamp 2, i.e. in the upline 15, and the grounded shield M of the ignition module. This parasitic capacitance $C_p$* is indicated in FIG. 6. The parasitic capacitance $C_p$* is directly charged to a very high potential of approximately 20 kV before ignition and again gets discharged immediately after by the spark occurring in the lamp container. The discharging of the capacitor $C_p$* occurs uniformly in parallel via the two electrical connections 5, 6, i.e. via the two terminals $x_1$, $x_2$. This is a so-termed common-mode disturbance, which can be reduced to a very acceptable level by the appropriate current-compensated choke $L_{1,2}$. A second effect appears, however, owing to a further parasitic capacitance C p which is parallel to the secondary winding $T_S$ of the transformer T. This parasitic capacitance C p is shown in FIG. 5 and causes a reverse-mode disturbance at the electrical connections 5, 6. The power of this pulse is reduced to a large extent by the transil diode D. The residuals of the pulse pass almost unimpaired through the current-compensated choke $L_{1,2}$. This part of the disturbance should therefore be blocked by the drawn filter capacitors $C_1$, $C_2$, $C_3$, $C_4$, $C_5$, $C_6$.

In experiments carried out for this purpose, however it was found that it is possible to replace these filter capacitors $C_1$, $C_2$, $C_3$, $C_4$, $C_5$, $C_6$ with an individual filter capacitor $C_7$, which couples the first electrical connection 5 and the second electrical connection 6 to one another at the input side upstream of the current-compensated choke $L_{1,2}$. A circuit arrangement 1 with such a structure is represented in FIG. 4. FIG. 4 also shows (by means of the arrows drawn parallel to the lines) the direction of the current pulses which are caused immediately after the ignition of the lamp by the parasitic capacitance $C_P$, which is parallel to the secondary coil $T_S$ of the transformer T. This representation renders it very clear that the current-compensated choke $L_{1,2}$ may have only a very minor effect on the current pulse portion caused by this parasitic capacitance $C_P$, but that this current pulse portion can very well be strongly reduced by the simple capacitor $C_7$ which couples the terminals $x_1$, $x_2$ at the input side to one another, such that rigorous limit values are still maintained. The filter capacitor $C_7$ has a value of approximately 500 pF in the embodiment shown. The capacitor $C_7$ renders a hitherto necessary expensive connection between the above-mentioned capacitors ($C_1$, $C_2$, $C_3$, $C_4$, $C_5$, $C_6$) and the shield M of the ignition module redundant, so that the assembly cost can be further reduced.

FIG. 5 shows a further modification of a circuit arrangement 1", in which an appropriate choice of the cables 9 between the terminals $x_1$ and $x_2$ and the ballast 10 leads to a parasitic capacitance $C_{7,P}$ between the cables 9, which may replace the capacitor $C_7$ shown in FIG. 5, which capacitor couples the inputs $x_1$ and $x_2$ (in this Fig. the directions of the current pulses are again represented by the arrows drawn parallel to the lines). Depending on cable type and cable length, parasitic capacitances from 5 to 50 pF may be easily obtained by means of the cables. The capacitances of the ballast output may also be used and may be sufficient, depending on the type of the ballast 10 (which normally still has another capacitor of its own in the lamp output), as well as those of the circuit arrangement used or the lamps used. If necessary, a more economical, smaller filter capacitor may alternatively be used at the input of the circuit device 1 in addition to these parasitic capacitances $C_{7,P}$.

The parasitic capacitors, particularly those parasitic capacitors that are to take over the function of the capacitors $C_1$, $C_2$, $C_3$ described above, may also be increased artificially in that, for example, conductive strips for the electrical connections 5, 6, 7 are widened or additional conductive surfaces are coupled, which are arranged, for example, at a certain distance to the housing of the circuit arrangement. A certain parasitic capacitance can be exactly defined in this manner.

Particularly, such a design of artificially increased, parasitic capacitors may also be used for reducing the high voltage on the return line 16 of the lamp 2 as quickly and as strongly as possible after an ignition of the lamp 2. For this purpose, refer to FIG. 6. (in FIG. 6 also, as in FIGS. 4 and 5, the directions of the current pulses are represented by arrows drawn parallel to the lines). The high voltage $U_{RL}$ on the return line 16 and in the circuit arrangement 1", i.e. in the ignition module 1", is determined here primarily by the ignition voltage $U_Z$, which is approximately equal to the maximum voltage across the parasitic capacitance $C_P$* drawn in FIG. 6, which capacitance is present between the high-voltage conductor (i.e. the upline 15 to the lamp 2) between the secondary coil $T_S$ of the transformer T and the high-pressure gas discharge lamp 2 and the grounded shield of the ignition module M. Furthermore, the voltage $U_{RL}$ is also determined by the parasitic capacitance $C_P$* itself and by a further parasitic capacitance $C_P$*. This further parasitic capacitance $C_P$* is present, as shown in FIG. 6, between the grounded shield M of the ignition module of the circuit arrangement 1" on the one hand and all components arranged in the circuit arrangement 1 between the current-compensated choke $L_{1,2}$ and the lamp 2 on the other hand, which components are at a lower potential before ignition. The dependence of the high voltage $U_{RL}$ on the return line 16 is given by the following equation.

$$U_{RL} = U_z \cdot \frac{C_P^*}{C_P^* + C_P^{***}}$$

From this equation it is evident that the high voltage $U_{RL}$ on the return line 16 may be reduced by increasing the parasitic capacitance $C_P$*. This capacitance $C_P$*, as mentioned above, may be increased artificially by increasing the surfaces of the conductive strips or by coupling additional conductive surfaces. An adjustment of the parasitic capacitance $C_P$*, however, is also possible by a special arrangement of the various components in the circuit arrangement 1". In this way, a circuit arrangement 1" can be manufactured economically, which fulfills all the requirements of reducing the electromagnetic interference, which definitely avoids an impairment of the ballast 10 while igniting the lamp 2, and which in addition ensures that after igniting the lamp 2 the high voltage pulse on the return line 16 is again reduced as quickly as possible. This concept for the economical reduction of the high voltage $U_{RL}$ on the return line 16 after ignition with the help of an artificial parasitic capacitance $C_P$* may indeed be used in other circuit arrangements without current-compensated chokes as well.

It is finally pointed out that the circuits and methods represented concretely in the Figs. and the description merely relate to examples of embodiments, which may be varied by those skilled in the art to a large extent without departing from the scope of the invention. In addition, it is pointed out for the sake of completeness that the use of the indefinite article "a" or "an" does not exclude that the relevant characteristics may also be present multiply.

The invention claimed is:

1. A circuit arrangement for driving a high-pressure gas discharge lamp, comprising:

a first terminal for a first voltage potential, a second terminal for a second voltage potential, a third terminal for applying a third voltage potential for igniting the high-pressure gas discharge lamp, a first electrical connection, which at its first end provides a first connection terminal for a high-pressure gas discharge lamp and which is coupled at its second end to the first terminal the first voltage potential, a second electrical connection, which at its first end provides a second connection terminal for a high-pressure gas discharge lamp and which is coupled at its second end to the second terminal for the second voltage potential, an ignition device, which at its input side is connected at least to the third terminal and is coupled at its output side to one of the terminals for the high-pressure gas discharge lamp, a first inductor arranged in the first electrical connection, as well as a second inductor arranged in the second electrical connection that forms a current-compensated choke through magnetic coupling with the first inductor that serves to reduce the interfering pulses appearing at the first terminal for the first voltage potential and at the second terminal for the second voltage potential, and an electrical resistor having a resistance value that is at least half an impedance of the inductors in a frequency range between 50 MHz and 150 MHz arranged in a third electrical connection between the ignition device and the third terminal and serves to reduce the interfering pulses appearing at the third terminal.

2. The circuit arrangement of claim 1, wherein the resistor has a value of at least 1 kΩ.

3. The circuit arrangement of claim 1, wherein the resistor has a value at least as great as the impedance of the inductors.

4. The circuit arrangement of claim 1, wherein:

a secondary winding of a transformer of the ignition device is arranged in the first electrical connection, and a side of a capacitor of the ignition device and a side of a primary winding of the transformer parallel thereto is connected to the first electrical connection between the first terminal for the first voltage potential and the secondary winding, and the third terminal is connected to the other side of the capacitor via the resistor and, parallel thereto, to the other side of the primary winding of the transformer via a switching element of the ignition device.

5. The circuit arrangement of claim 1, wherein the first electrical connection between the first inductor and the first connection terminal for the high-pressure gas discharge lamp on the one side and the second electrical connection between the second inductor and the second terminal for the high-pressure gas discharge lamp on the other side are interconnected via a voltage-limiting element.

6. The circuit arrangement of claim 1, including a capacitor that couples the first electrical connection and the second electrical connection at the input side upstream of the current-compensated choke, the capacitor having a value that is larger than an inherent parasitic capacitance between the first and second electrical connections serves to reduce the interfering pulses appearing at the first and second connections.

7. The circuit arrangement of claim 6, wherein the capacitive coupling occurs via a parasitic capacitance.

8. A lamp unit with a high-pressure gas discharge lamp and with a circuit arrangement as claimed in claim 1.

9. A lamp unit as claimed in claim 8, wherein the circuit arrangement is integrated into a socket housing of the high-pressure gas discharge lamp.

10. A headlight with a lamp unit as claimed in claim 8.

11. The circuit arrangement of claim 1, wherein the resistor has a value of at least 5 kΩ.

12. The circuit arrangement of claim 1, wherein the resistor has a value of at least 20 kΩ.

13. A method of controlling a high-pressure gas discharge lamp comprising:

supplying the high-pressure gas discharge lamp with an operating voltage in a stationary operation via a first electrical connection with a first terminal for a first voltage potential and a first connection terminal for the high-pressure gas discharge lamp and via a second electrical connection with a second terminal for a second voltage potential and a second connection terminal for the high-pressure gas discharge lamp, and, for the purpose of igniting the high-pressure gas discharge lamp, applying a high-voltage pulse to one of the connection terminals of the high-pressure gas discharge lamp, which pulse is produced in an ignition device in that a third voltage potential is applied to a third terminal connected to the ignition device at the input side, wherein a first inductor is arranged in the first electrical connection and a second inductor is arranged in the second electrical connection, which second inductor together with the first inductor forms, through magnetic coupling, a current-compensated choke, that serves to reduce the interfering pulses appearing at the first terminal for the first voltage potential and at the second terminal for the second voltage potential, and wherein an electrical resistor having a resistance value of at least half an impedance of the inductors within a frequency range of 50 MHz-150 MHz is arranged between the ignition device and the third terminal and serves to reduce the interfering pulses appearing at the third terminal.

14. The circuit arrangement of for driving a high-pressure gas discharge lamp, comprising:

a first terminal for a first voltage potential, a second terminal for a second voltage potential, a third terminal for applying a third voltage potential for igniting the high-pressure gas discharge lamp, a first electrical connection, which at its first end provides a first connection terminal for a high-pressure gas discharge lamp and which is coupled at its second end to the first terminal for the first voltage potential, a second electrical connection, which at its first end provides a second connection terminal for a high-pressure gas discharge lamp and which is coupled at its second end to the second terminal for the second voltage potential, an ignition device, which at its input side is connected at least to the third terminal and is coupled at its output side to one of the terminals for the high-pressure pas discharge lamp, a first inductor arranged in the first electrical connection, as well as a second inductor arranged in the second electrical connection which forms a current-compensated choke through magnetic coupling with the first inductor, and an electrical resistor of more than 10Ω arranged in a third electrical connection between the ignition device and the third terminal, wherein a parasitic capacitance between the first electrical connection and the second electrical connection and/or a parasitic capacitance between the first electrical connection and a surrounding ground and/or a parasitic capacitance between the second electrical connection and a surrounding ground and/or a parasitic capacitance between the third electrical connection and a surrounding ground is increased through widening of a conductor track of the relevant electrical connection and/or by electrically connecting at least one additional conducting surface to said relevant electrical connection.

15. The circuit arrangement of claim 14, wherein the resistor has a value of at least 1 kΩ.

16. The circuit arrangement of claim 14, wherein the resistor has a value greater than an impedance of the inductors within a given frequency range.

17. The circuit arrangement of claim 16, wherein the frequency range lies between 50 MHz and 150 MHz.

18. The circuit arrangement of claim 14, wherein:

a secondary winding of a transformer of the ignition device is arranged in the first electrical connection, and a side of a capacitor of the ignition device and a side of a primary winding of the transformer parallel thereto is connected to the first electrical connection between the first terminal for the first voltage potential and the secondary winding, and the third terminal is connected to the other side of the capacitor via the resistor and, parallel thereto, to the other side of the primary winding of the transformer via a switching element of the ignition device.

19. The circuit arrangement of claim 14, including a capacitor that couples the first electrical connection and the second electrical connection at the input side upstream of the current-compensated choke, the capacitor having a value that is larger than an inherent parasitic capacitance between the first and second electrical connections.

20. A circuit arrangement comprising:

a first inductor in series between a first voltage source and a first input of an ignition device that is coupled to a first terminal of a high-pressure discharge lamp, a second inductor in series between a second voltage source and a second terminal of the high-pressure discharge lamp, the first and second inductors forming a current-compensated choke with an input side coupled to the first and second voltage sources, a resistor in series between a third voltage source and a second input of the ignition device, and a capacitor that couples the first and second inductors on the input side of the choke, wherein:

values of the inductors, resistor, and capacitor are selected so as to reduce interference within a given frequency range, and the resistor has a value that is based on an impedance of the inductors within the given frequency range.

21. The circuit arrangement of claim 20, wherein the frequency range lies between 50 MHz and 150 MHz.

* * * * *